United States Patent [19]

Ingaglio

[11] 4,399,608

[45] Aug. 23, 1983

[54] SPADE LUG RECEPTACLE FITTING TOOL

[75] Inventor: Michael L. Ingaglio, Randolph, N.J.

[73] Assignee: Bell Telephone Laboratories, Incorporated, Murray Hill, N.J.

[21] Appl. No.: 333,638

[22] Filed: Dec. 23, 1981

[51] Int. Cl.[3] ..... H01R 43/00

[52] U.S. Cl. ..... 29/747; 29/758; 29/854

[58] Field of Search ..... 29/747, 758, 750–752, 29/278, 854–856

[56] References Cited

U.S. PATENT DOCUMENTS 3,574,254 4/1971 Harris ..... 29/747

FOREIGN PATENT DOCUMENTS 2458945 6/1976 Fed. Rep. of Germany ..... 29/747

*Primary Examiner*—Carl E. Hall

*Attorney, Agent, or Firm*—W. H. Kamstra

[57] ABSTRACT

A tool (10) for fitting a conductor terminating receptacle (11) on a spade lug terminal (12) of an electrical component (16). The tool (10) comprises a circular rod (21) one end of which is formed to present a tab (23) cut along a chord of the cross-section of the rod (21) having an inner surface (24) tangent to a hole (22) formed into the rod (21) from its end coaxial with its longitudinal axis. The rolled conductor contact section (19) of a receptacle is inserted in the end hole (22), the conductor (20) extending outside of the hole (22) through a slot (25) in the side of the rod (21) along the depth of the hole (22). The receptacle (11) is clasped between the extended tab (23) which bears on the rear face (28) of the receptacle (11) and a pair of short lugs (26, 27) extending from the end of the rod (21) on either side of the slot (25), which lugs either fit into the folded over sides (17, 18) of the receptacle or bear against their ends.

4 Claims, 4 Drawing Figures

FIG. 1
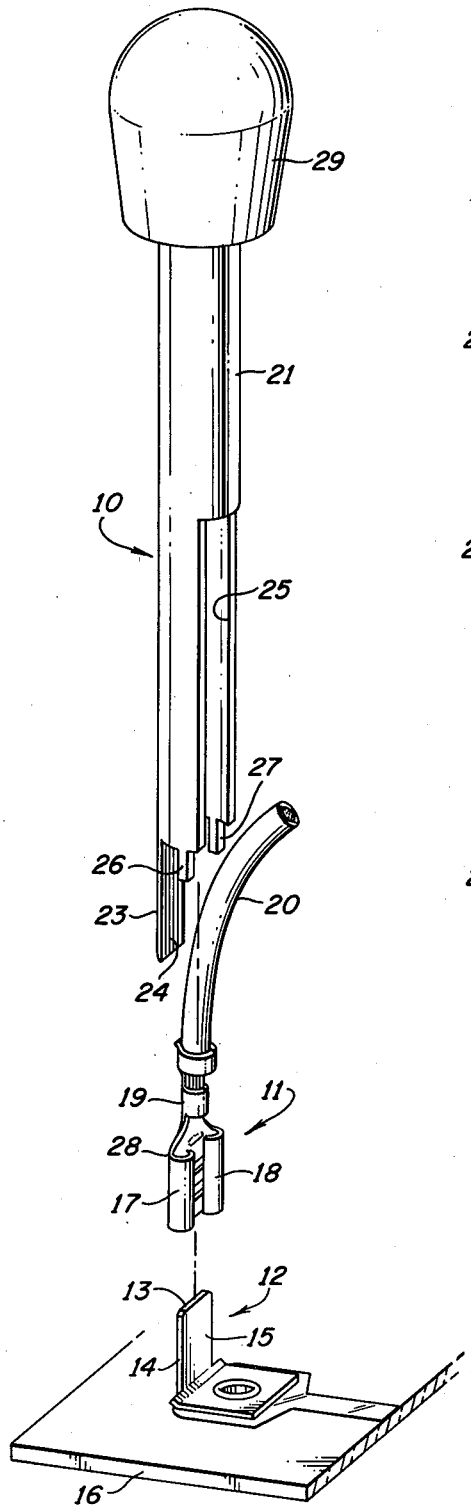
FIG. 2
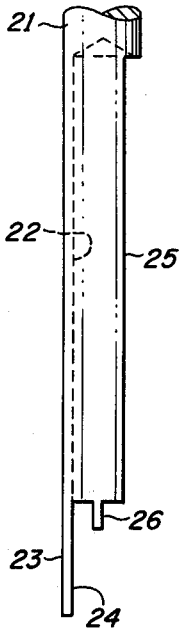
FIG. 3
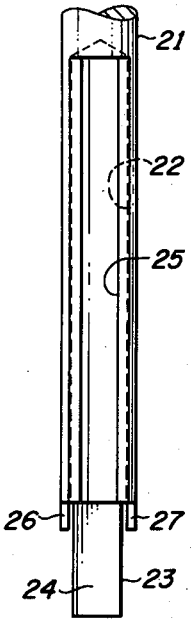
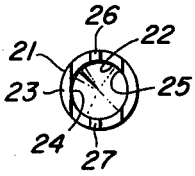
FIG. 4

SPADE LUG RECEPTACLE FITTING TOOL

TECHNICAL FIELD

This invention relates to devices and apparatus for interconnecting electrical conductors and terminals of electrical components and the like and, more particularly, to tools for facilitating such interconnection.

BACKGROUND OF THE INVENTION

Terminals of electronic components to which electrical conductors may be connected have taken various and numerous forms, generally as determined by the manner in which the conductors are to be attached which in turn is determined by the permanence of the connection desired. On widely used terminal commonly called a spade lug, when employed in association with a special conductor termination, permits a quick connection and disconnection of the two elements. The lug terminal comprises a rectangular flat strip presenting two opposite, parallel edges. The conductor is crimped or otherwise electrically secured to a terminal receptacle comprising a flat, generally rectangular strip, the opposite sides of which are folded over to receive the opposite edges of the spade lug terminal. With the receptacle frictionally fitted on the lug terminal, a connection is made which is both mechanically and electrically reliable.

In the past, the receptacle has been fitted on the lug terminal either manually or by whatever shop tool was most convenient. This has proved awkward, particularly when a number of the lug terminals are closely spaced and frequently inconvenient when access to a lug terminal is limited. It is accordingly an object of the invention to provide a tool for facilitating the fitting of a conductor receptacle on a spade lug terminal, which tool is both simple and inexpensive.

SUMMARY OF THE INVENTION

The foregoing and other objects are realized in one illustrative tool, according to the invention, comprising a circular rod formed at one end to present a tab extending from one side of a hole drilled into the end of the rod coaxial with the longitudinal axis of the rod. Directly opposite the tab, the rod is slotted parallel to its axis permitting access to the drilled hole. A pair of short lugs extend from the end of the rod on opposite sides of the drilled hole spaced 90 degrees from the longer tab. The other end of the rod is fitted with a knob for ease of handling. The tool is advantageously operated to fit to a spade lug terminal a conductor terminal receptacle which provides for the crimping of a conductor at its conductor contact section by enfolding the sides of the section to form a roll extending straight out from the receptacle. The conductor roll and conductor are inserted into the rod end hole, the conductor extending out of the slot until the small end lugs either fit into the receptacle folded sides or abut thereagainst. With the tool thus fitted, its longer end tab will bear against the rear face of the receptacle which may then be readily fitted in turn on a spade lug terminal. The rod is determined of sufficient length to reach the terminal despite limited access.

BRIEF DESCRIPTION OF THE DRAWING

A conductor receptacle fitting tool and its operation according to the principles of the invention will be better understood from a consideration of the detailed description of one illustrative embodiment thereof which follows when taken in conjunction with the accompanying drawing in which:

FIG. 1 is a perspective view of an illustrative spade lug receptacle tool according to the invention shown in position preparatory to its operation in fitting a typical conductor receptacle to a spade lug terminal;

FIG. 2 is a side view of the operative end of the tool of FIG. 1;

FIG. 3 is a front view of the operative end of the tool shown in FIGS. 1 and 2; and FIG. 4 is an end view of the tool shown in the foregoing figures.

DETAILED DESCRIPTION

Referring now to the drawing, a spade lug terminal receptacle fitting tool 10, according to the invention, is seen in FIG. 1 preparatory to fitting a conventional conductor receptacle 11 to a spade lug terminal 12. The latter terminal comprises an electrically conductive strip 13 having opposite parallel edges 14 and 15 which terminal extends from or may be affixed to an electrical component such as, for example, an electrical circuit board 16, a portion of which is shown. Receptacle 11 comprises an electrically conductive strip having parallel folded-over sides 17 and 18 adapted to frictionally clasp terminal lug 13 at its edges 14 and 15, respectively. Each folded over side defines in part an axially extending recess. Extending straight out from folded sides 17 and 18 is a conductor contacting section 19 which is rolled about a conductor 20 to achieve electrical contact and strain relief as is also known.

Tool 10 comprises a rod 21 of any suitable sturdy material having, in the illustrative embodiment being described, a substantially circular cross-section, which rod has a circular hole 22 formed therein for a distance from one end (See also FIGS. 2 through 4) coaxial with the longitudinal axis of rod 21. The latter rod is further formed to present a tab 23 extending from its end having a surface 24 substantially tangent to the surface of the hole 22. The cross-section of the tab 23 is a segment of a circle, bounded at the chord by surface 24, and bounded at the arc by the outer surface of the rod 21. A slot 25 is formed in rod 21 parallel to its longitudinal axis along the length of hole 22 directly opposite to surface 24 of tab 23 permitting access to hole 22 at one side. A pair of small lugs 26 and 27 extend from the end of rod 21 on either side of slot 25. Lugs 26 and 27 are dimensioned and positioned for fitting inside the folded over sides 17 and 18 of receptacle 11 as surface 24 of tab 23 bears against the rear surface 28 of receptacle 11. A knob 29, fitted at the other end of rod 21 for ease of handling, completes the assembly and construction of tool 10. The length of rod 21 is determined for convenience in the physical environment in which tool 10 is to be used.

Tool 10 is simply operated by inserting the rolled conductor contact section 19 of receptacle 11 into hole 22 of rod 21, the conductor 20 extending outward through slot 25, until lugs 26 and 27 are fully inserted into the openings formed by the folded sides 17 and 18 of receptacle 11. At this point, surface 24 of tab 23 will bear against the rear face 28 of the receptacle. Tool 10 is now handled to fit receptacle 11 over spade lug terminal 12. A receptacle 11 may be encountered in which the contours of the transition between conductor contact section 19 and the folded over sides 17 and 18 prevent insertion of lugs 26 and 27. In this case, lugs 26 and 27 are fitted against the ends of folded over sides 17 and 18, the receptacle then being clasped between the latter lugs and tab 23.

What has been described is considered to be only one specific illustrative spade lug receptacle fitting tool according to the invention. Accordingly, it is to be understood that various and numerous other arrangements may be devised by one skilled in the art without departing from the spirit and scope of the invention as limited only by the accompanying claims.

What is claimed is:

1. A tool for fitting a conductor receptacle to a spade lug terminal, said receptacle having a pair of folded over sides for receiving the sides of said terminal, each folded over side defining in part an axially extending recess, and a conductor contact section folded about said conductor, the end of said conductor extending substantially parallel to said folded over sides, said tool comprising a rod having a hole formed therein from one end coaxial with its longitudinal axis, said hole receiving the folded conductor contact section of said receptacle, said one end of said rod further having a slot formed therein to said hole parallel to said longitudinal axis, said slot admitting said conductor, a tab extending beyond said one end of said rod having a surface substantially tangent to the inner surface of said hole, said tab bearing on one side of said receptacle when said folded conductor contact section of said receptacle is fitted into said hole, and a pair of lugs extending beyond said one end of said rod on respective opposite sides of said slot, said lugs fitting within respective ones of the axially extending recesses of said folded over sides, of said receptacle when said folded conductor contact section of said receptacle is fitted into said hole.

2. A tool as claimed in claim 1 in which said pair of lugs are dimensioned and positioned to fit within said folded over sides, respectively, of said receptacle when said folded conductor contact section of said receptacle is fitted into said hole.

3. A tool as claimed in claims 1 or 2 in which said rod is of substantially circular cross-section and in which said surface of said tab lies along a chord of the cross-section of said rod.

4. A tool as claimed in claims 1 or 2 also comprising a knob fitted on the other end of said rod.

* * * * *